US010016025B1

(12) United States Patent
Lin

(10) Patent No.: US 10,016,025 B1
(45) Date of Patent: Jul. 10, 2018

(54) ZIPPER HEAD ASSEMBLY STRUCTURE AND PIN-SHAPED ASSEMBLY THEREOF

(71) Applicant: CHUNG CHWAN ENTERPRISE CO., LTD., Taoyuan (TW)

(72) Inventor: Yu-Pau Lin, Taoyuan (TW)

(73) Assignee: CHUNG CHWAN ENTERPRISE CO., LTD., Taoyuan (TW)

( * ) Notice: Subject to any disclaimer, the term of this patent is extended or adjusted under 35 U.S.C. 154(b) by 0 days.

(21) Appl. No.: 15/687,488

(22) Filed: Aug. 27, 2017

(30) Foreign Application Priority Data

May 24, 2017 (TW) ..... 106117209 A

(51) Int. Cl.
*A44B 19/26* (2006.01)

(52) U.S. Cl.
CPC ..... *A44B 19/26* (2013.01)

(58) Field of Classification Search
CPC ... A44B 19/26; A44B 19/382; Y10T 24/2593; Y10T 24/2509
See application file for complete search history.

(56) References Cited

U.S. PATENT DOCUMENTS 6,112,376 A * 9/2000 Akashi ..... A44B 19/388 24/388
6,775,885 B1 * 8/2004 Wang ..... A44B 19/382 24/385
8,806,725 B2 * 8/2014 Keyaki ..... A44B 19/382 24/427
9,549,593 B2 * 1/2017 Kojima ..... A44B 19/08
2004/0205942 A1 * 10/2004 Tsaur ..... A44B 19/388 24/433
2005/0278904 A1 * 12/2005 Matsumoto ..... A44B 19/38 24/433
2006/0282998 A1 * 12/2006 Kusayama ..... A44B 19/382 24/434
2008/0092347 A1 * 4/2008 Ogura ..... A44B 19/382 24/433
2009/0094805 A1 * 4/2009 Keyaki ..... A44B 19/382 24/433

(Continued)

FOREIGN PATENT DOCUMENTS

TW 201340905 A 10/2013
TW 201521624 A 6/2015
TW 201021739 A 6/2016

*Primary Examiner* — Robert Sandy
*Assistant Examiner* — Rowland Do
(74) *Attorney, Agent, or Firm* — Li & Cai Intellectual Property (USA) Office

(57) ABSTRACT

A zipper head assembly structure includes a pin-shaped assembly. The pin-shaped assembly includes a first pin element and a second pin element. The first pin element includes a first body, a first flange portion, a first mating portion, and a first front portion. The second pin element includes a second body, a second flange portion, a second mating portion, and a second front portion. The first flange portion is projected outwardly from a first left wall of the first body and adjacent to a rear side of the first body. The second flange portion is projected outwardly from a second right wall of the second body and adjacent to a rear side of the second body. The first pin element and the second pin element are detachably connected to each other by matching the first mating portion and the second mating portion.

8 Claims, 16 Drawing Sheets

(56) References Cited

U.S. PATENT DOCUMENTS

| | | | | |
|---|---|---|---|---|
| 2010/0293760 | A1* | 11/2010 | Lin | A44B 19/382<br>24/415 |
| 2010/0299887 | A1* | 12/2010 | Lin | A44B 19/382<br>24/433 |
| 2012/0124788 | A1* | 5/2012 | Keyaki | A44B 19/382<br>24/386 |
| 2012/0167354 | A1* | 7/2012 | Keyaki | A44B 19/388<br>24/386 |
| 2013/0074292 | A1* | 3/2013 | Nozaki | A44B 19/38<br>24/415 |
| 2013/0074293 | A1* | 3/2013 | Mikuma | A44B 19/32<br>24/430 |

* cited by examiner

ZIPPER HEAD ASSEMBLY STRUCTURE AND PIN-SHAPED ASSEMBLY THEREOF

CROSS REFERENCE TO RELATED APPLICATION

This application claims foreign priority benefits under 35 U.S.C. § 119(a)-(d) to TW 106117209, filed on 24 May 2017 and entitled "ZIPPER HEAD ASSEMBLY STRUCTURE AND PIN-SHAPED ASSEMBLY THEREOF", now pending, the entire disclosures of which are incorporated herein by reference.

FIELD OF THE INVENTION

The present disclosure relates to an assembly structure and a pin-shaped assembly thereof, and more particularly to a zipper head assembly structure and a pin-shaped assembly thereof.

BACKGROUND OF THE INVENTION

Generally, articles of clothing rely on either buttons or zippers to bind themselves together. In contrast to the button, however, the zipper provides stronger structural integrity and a smoother operation. A zipper assembly usually includes a zipper head and a strip, the former of which serves as the connecting component with the latter and cooperates therewith to allow the zipper assembly to be zipped back and forth. However, despite wide application of the zipper across various clothing and accessories, the cooperative operation between the zipper assembly and the conventional inserting pins/fixed pins of the zipper head thereof still leaves room for improvement.

SUMMARY OF THE INVENTION

One aspect of the present disclosure relates to a zipper head assembly structure and a pin-shaped assembly thereof.

One of the embodiments of the present disclosure provides a pin-shaped assembly, including a first pin element and a second pin element. The first pin element includes a first body, a first flange portion, a first mating portion, and a first front portion, and the first body has a first left wall and a first right wall opposite to the first left wall. The second pin element includes a second body, a second flange portion, a second mating portion, and a second front portion, and the second body has a second left wall and a second right wall opposite to the second left wall. The first flange portion is projected outwardly from the first left wall of the first body and is adjacent to a rear side of the first body, the first mating portion is disposed on the first right wall of the first body, and the first front portion is disposed on a front side of the first body. The second flange portion is projected outwardly from the second right wall of the second body and is adjacent to a rear side of the second body, the second mating portion is disposed on the second left wall of the second body, and the second front portion is disposed on a front side of the second body. The first pin element and the second pin element are detachably connected to each other by matching the first mating portion and the second mating portion.

Another one of the embodiments of the present disclosure provides a pin-shaped assembly, including a first pin element and a second pin element. The first pin element includes a first body, a first top groove, a first bottom groove, a first mating portion, and a first front portion. The first body has a first left wall, a first right wall opposite to the first left wall, a first top wall connected between the first left wall and the first right wall, and a first bottom wall opposite to the first top wall. The second pin element includes a second body, a second top groove, a second bottom groove, a second mating portion, and a second front portion. The second body has a second left wall, a second right wall opposite to the second left wall, a second top wall connected between the second left wall and the second right wall, and a second bottom wall opposite to the second top wall. The first top groove is disposed on the first top wall of the first body, the first bottom groove is disposed on the first bottom wall of the first body, the first mating portion is disposed on the first right wall of the first body, and the first front portion is disposed on a front side of the first body. The second top groove is disposed on the second top wall of the second body, the second bottom groove is disposed on the second bottom wall of the second body, the second mating portion is disposed on the second left wall of the second body, and the second front portion is disposed on a front side of the second body. The first pin element and the second pin element are detachably connected to each other by having the first mating portion and the second mating portion be complementary in structure.

Yet another one of the embodiments of the present disclosure provides a zipper head assembly structure, including a zipper head assembly and a pin-shaped assembly. The zipper head assembly includes a first zipper head and a second zipper head detachably mated with the first zipper head, and the first zipper head has a first inner wall and a second inner wall opposite to the first inner wall. The pin-shaped assembly is mated with the zipper head assembly, and the pin-shaped assembly includes a first pin element and a second pin element, and both the first pin element and the second pin element are inserted into the zipper head assembly. The first pin element includes a first body, a first flange portion, a first mating portion, and a first front portion, and the first body has a first left wall and a first right wall opposite to the first left wall. The first flange portion is projected outwardly from the first left wall of the first body and is adjacent to a rear side of the first body, the first mating portion is disposed on the first right wall of the first body, and the first front portion is disposed on a front side of the first body. The second pin element includes a second body, a second flange portion, a second mating portion, and a second front portion, and the second body has a second left wall and a second right wall opposite to the second left wall. The second flange portion is projected outwardly from the second right wall of the second body and is adjacent to a rear side of the second body, the second mating portion is disposed on the second left wall of the second body, and the second front portion is disposed on a front side of the second body. The first pin element and the second pin element are detachably connected to each other by matching the first mating portion and the second mating portion.

Therefore, by matching the features of "the first mating portion being disposed on the first right wall of the first body, and the second mating portion being disposed on the second left wall of the second body" and "the first mating portion and the second mating portion being mated with each other", the first pin element and the second pin element can be detachably connected to each other.

To further understand the techniques, means and effects of the present disclosure, the following detailed descriptions and appended drawings are hereby referred to, such that, and through which, the purposes, features and aspects of the present disclosure can be thoroughly and concretely appreciated. However, the appended drawings are provided solely for reference and illustration, without any intention to limit the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DETAILED DESCRIPTION OF THE PREFERRED EMBODIMENTS

Embodiments of a zipper head assembly structure and a pin-shaped assembly thereof according to the present disclosure are described herein. Other advantages and objectives of the present disclosure can be easily understood by one skilled in the art from the disclosure. The present disclosure can be applied in different embodiments. Various modifications and variations can be made to various details in the description for different applications without departing from the scope of the present disclosure. The drawings of the present disclosure are provided only for simple illustrations, but are not drawn to scale and do not reflect the actual relative dimensions. The following embodiments are provided to describe in detail the concept of the present disclosure, and are not intended to limit the scope thereof in any way.

Referring to FIG. 1 to FIG. 7, the present disclosure provides a pin-shaped assembly S1, including a first pin element 1 and a second pin element 2. For example, the first pin element 1 may be an inserting pin, and the second pin element 2 may be a fixed pin, but it is merely an example and is not meant to limit the scope of the present disclosure.

Figure 1:
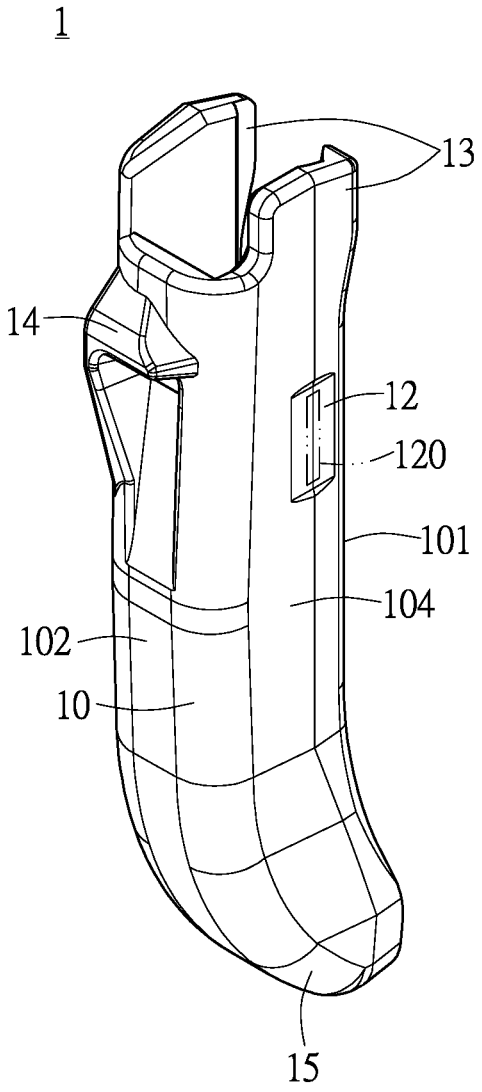
FIG. 1 shows a perspective schematic view of a first pin element of a pin-shaped assembly according to the present disclosure.
Figure 2:
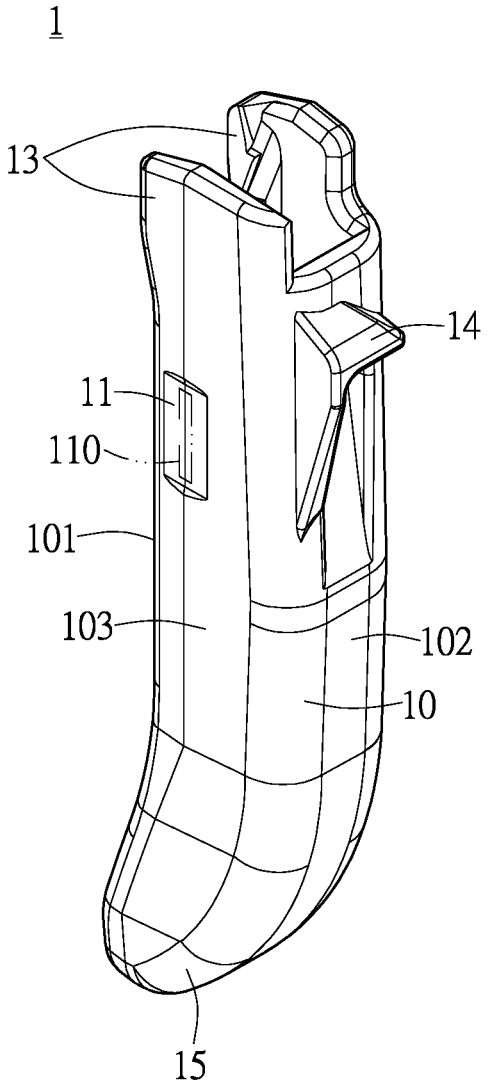
FIG. 2 shows another perspective schematic view of the first pin element of the pin-shaped assembly according to the present disclosure.
Figure 3:
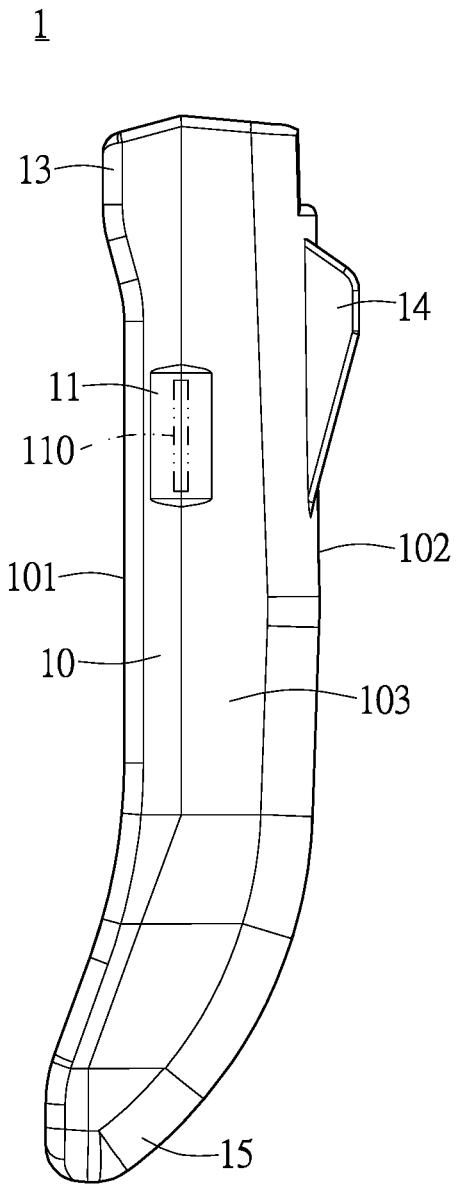
FIG. 3 shows a top schematic view of the first pin element of the pin-shaped assembly according to the present disclosure.
Figure 4:
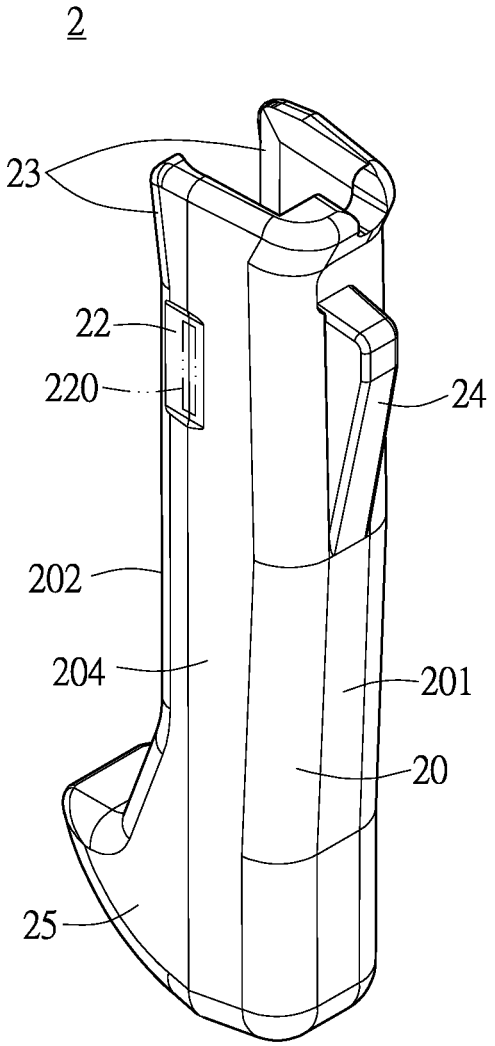
FIG. 4 shows a perspective schematic view of a second pin element of the pin-shaped assembly according to the present disclosure.
Figure 5:
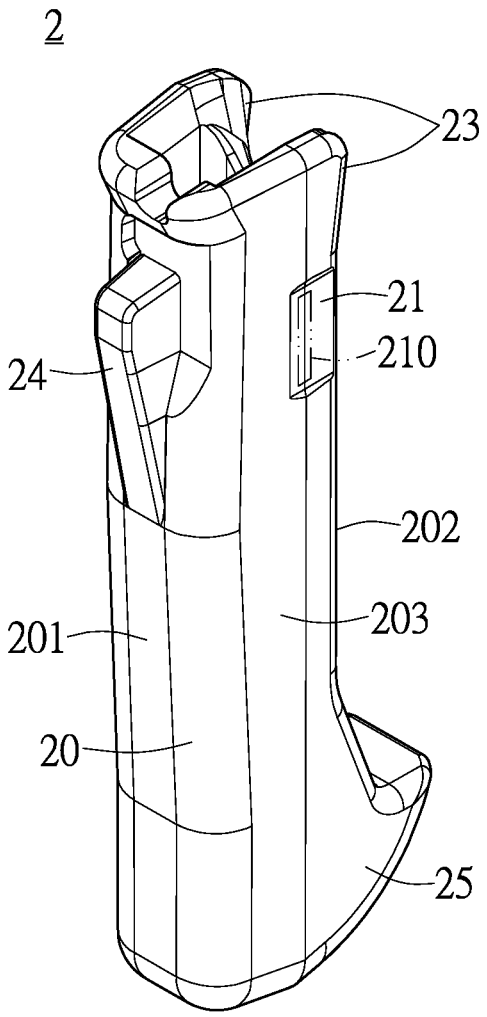
FIG. 5 shows another perspective schematic view of the second pin element of the pin-shaped assembly according to the present disclosure.

Firstly, referring to FIG. 1 to FIG. 3, the first pin element 1 includes a first body 10, a first top groove 11, and a first bottom groove 12. In addition, referring to FIG. 4 to FIG. 6, the second pin element 2 includes a second body 20, a second top groove 21, and a second bottom groove 22.

More particularly, referring to FIG. 1 to FIG. 3, the first body 10 has a first left wall 101, a first right wall 102 opposite to the first left wall 101, a first top wall 103 connected between the first left wall 101 and the first right wall 102, and a first bottom wall 104 opposite to the first top wall 103. In addition, referring to FIG. 4 to FIG. 6, the second body 20 has a second left wall 201, a second right wall 202 opposite to the second left wall 201, a second top wall 203 connected between the second left wall 201 and the second right wall 202, and a second bottom wall 204 opposite to the second top wall 203.

More particularly, referring to FIG. 1 to FIG. 3, the first top groove 11 is disposed on the first top wall 103 of the first body 10, and the first bottom groove 12 is disposed on the first bottom wall 104 of the first body 10. In addition, referring to FIG. 4 to FIG. 6, the second top groove 21 is disposed on the second top wall 203 of the second body 20, and the second bottom groove 22 is disposed on the second bottom wall 204 of the second body 20.

More particularly, referring to FIG. 1 to FIG. 3, the first pin element 1 includes a first flange portion 13, and the first flange portion 13 is projected outwardly from the first left wall 101 of the first body 10 and is adjacent to a rear side of the first body 10. In addition, referring to FIG. 4 to FIG. 6, the second pin element 2 includes a second flange portion 23, and the second flange portion 23 is projected outwardly from the second right wall 202 of the second body 20 and is adjacent to a rear side of the second body 20.

More particularly, referring to FIG. 1 to FIG. 3, the first pin element 1 includes a first mating portion 14, and the first mating portion 14 is disposed on the first right wall 102 of the first body 10. In addition, referring to FIG. 4 to FIG. 6, the second pin element 2 has a second mating portion 24, and the second mating portion 24 is disposed on the second left wall 201 of the second body 20. For example, the first mating portion 14 and the second mating portion 24 may be two latches mated with each other, but it is merely an example and is not meant to limit the scope of the present disclosure.

More particularly, referring to FIG. 1 to FIG. 3, the first pin element 1 includes a first front portion 15, and the first front portion 15 is disposed on a front side of the first body 10, so that the first front portion 15 can be used as a guide portion. In addition, referring to FIG. 4 to FIG. 6, the second pin element 2 includes a second front portion 25, and the second front portion 25 is disposed on a front side of the second body 20, so that the second front portion 25 can be used as a hook portion.

Figure 6:
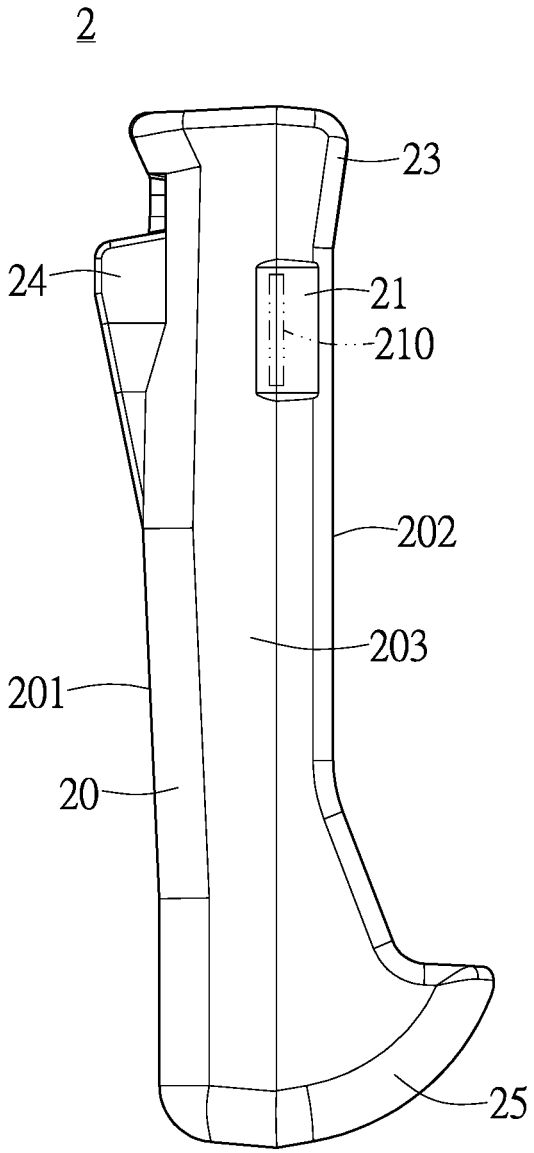
FIG. 6 shows a top schematic view of the second pin element of the pin-shaped assembly according to the present disclosure.
Figure 7:
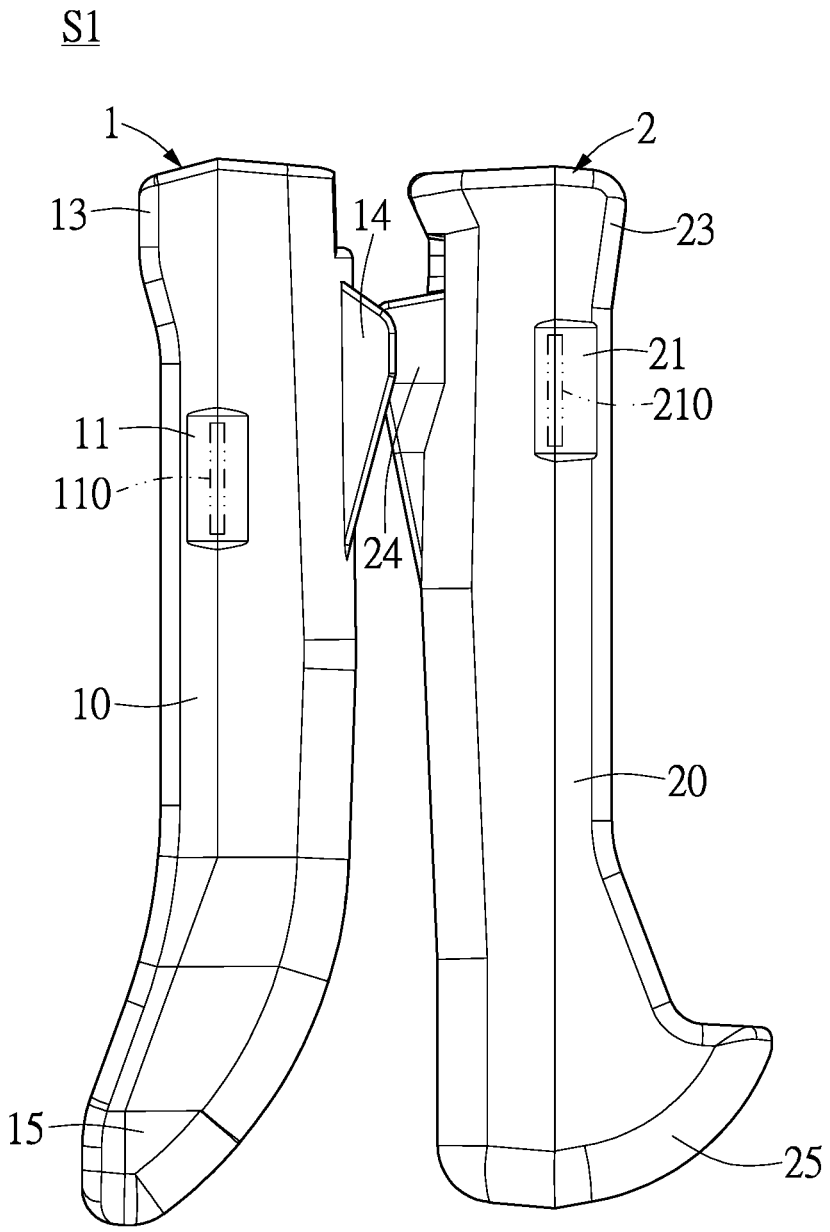
FIG. 7 shows a top schematic view of the first pin element and the second pin element being detachably connected to each other according to the present disclosure.

Therefore, referring to FIG. 3, FIG. 6, and FIG. 7, the first pin element 1 and the second pin element 2 can be detachably connected to each other by matching the first mating portion 14 and the second mating portion 24. For example, as shown in FIG. 7, when the first mating portion 14 is mated with the second mating portion 24, the first pin element 1 and the second pin element 2 are connected with each other. Referring to FIG. 3 and FIG. 6, when the first mating portion 14 is separated from the second mating portion 24, the first pin element 1 and the second pin element 2 are separated from each other.

More particularly, referring to FIG. 1 to FIG. 3, FIG. 8, and FIG. 9, the first top groove 11 has a first top connection portion 110 being communicated with a first overflow opening F1, and the first bottom groove 12 has a first bottom connection portion 120 being communicated with a second overflow opening F2.

As described above, as shown in FIG. 8, the first top connection portion 110 that is communicated with the first overflow opening F1 can be formed in the first top groove 11 during the manufacturing process of the first pin element 1, so that when the first pin element 1 is separated from the first overflow opening F1 (that is to say, when the first pin element 1 is broken off so as to segregate the overflow particle P), even if a residual material generated by breaking off the first pin element 1 is usually formed on the first top connection portion 110, the residual material is still received in the first top groove 11 without projecting out of the first top wall 103 of the first pin element 1. In addition, as shown in FIG. 9, the first bottom connection portion 120 that is communicated with the second overflow opening F2 can be formed in the first bottom groove 12 during the manufacturing process of the first pin element 1, so that when the first pin element 1 is separated from the second overflow opening F2 (that is to say, when the first pin element 1 is broken off so as to segregate the overflow particle P), even if a residual material generated by breaking the first pin element 1 is usually formed on the first bottom connection portion 120, the residual material is still received in the first bottom groove 12 without projecting out of the first bottom wall 104 of the first pin element 1.

Figure 8:
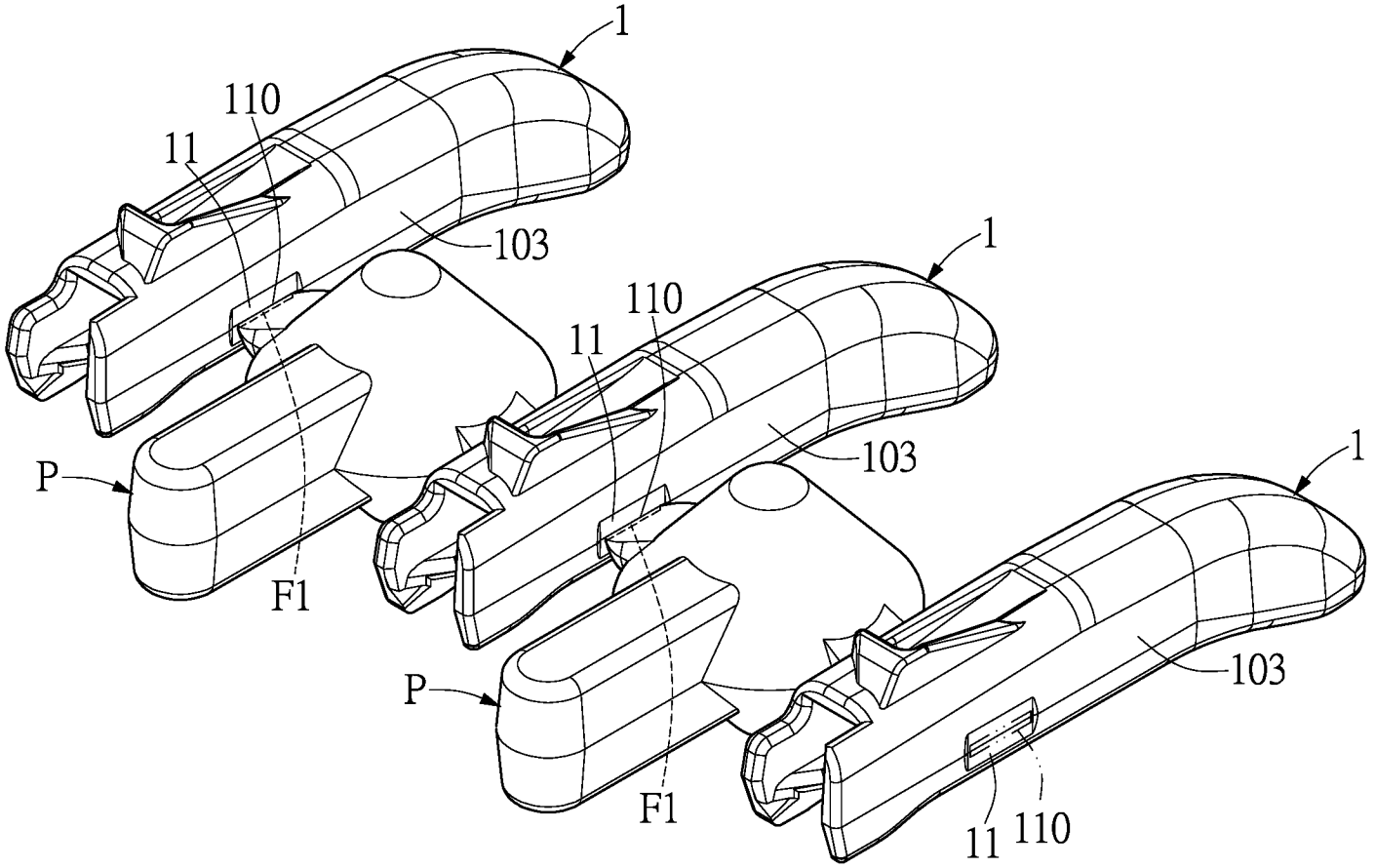
FIG. 8 shows a perspective schematic view of the first pin element being broken off so as to segregate the overflow particle according to the present disclosure.
Figure 9:
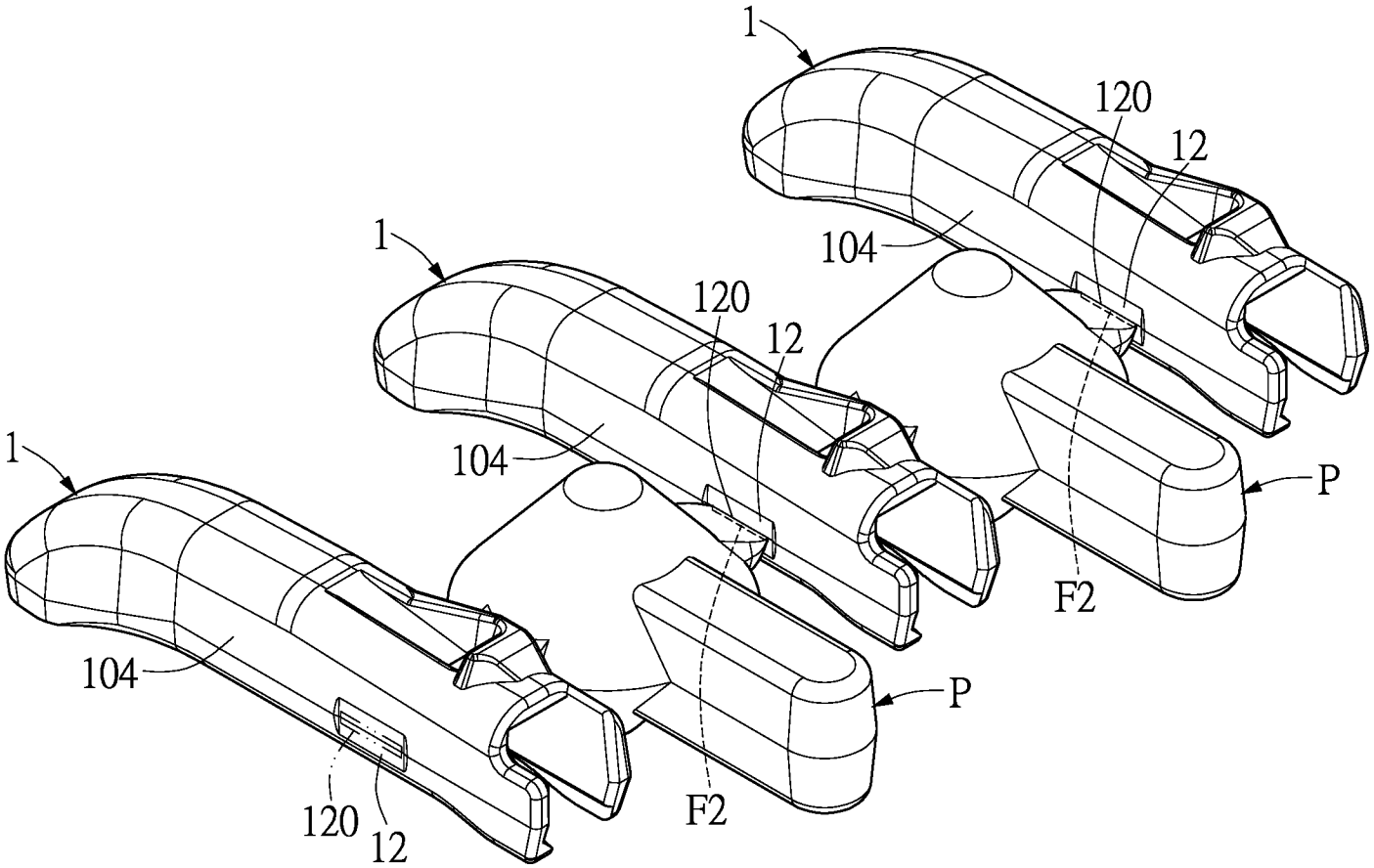
FIG. 9 shows another perspective schematic view of the first pin element being broken off so as to segregate the overflow particle according to the present disclosure.

In conclusion, the residual material is still received in the first top groove 11 without projecting out of the first top wall 103 of the first pin element 1 (that is to say, the residual material does not project out of the contours of the first pin element 1 as shown in FIG. 8), and the residual material is still received in the first bottom groove 12 without projecting out of the first bottom wall 104 of the first pin element 1 (that is to say, the residual material does not project out of the contours of the first pin element 1 as shown in FIG. 9), so that the efficiency of the automatic production line for making the first pin element 1 can be increased.

More particularly, referring to FIG. 4 to FIG. 6, FIG. 10, and FIG. 11, the second top groove 21 has a second top connection portion 210 being communicated with a third overflow opening F3, and the second bottom groove 22 has a second bottom connection portion 220 being communicated with a fourth overflow opening F4.

As described above, as shown in FIG. 10, the second top connection portion 210 that is communicated with the third overflow opening F3 can be formed in the second top groove 21 during the manufacturing process of the second pin element 2, so that when the second pin element 2 is separated from the third overflow opening F3 (that is to say, when the second pin element 2 is broken off so as to segregate the overflow particle P), even if a residual material generated by breaking the second pin element 2 is usually formed on the second top connection portion 210, the residual material is still received in the second top groove 21 without projecting out of the second top wall 203 of the second pin element 2. In addition, as shown in FIG. 11, the second bottom connection portion 220 that is communicated with the fourth overflow opening F4 can be formed in the second bottom groove 22 during the manufacturing process of the second pin element 2, so that when the second pin element 2 is separated from the fourth overflow opening F4 (that is to say, when the second pin element 2 is broken off so as to segregate the overflow particle P), even if a residual material generated by breaking the second pin element 2 is usually formed on the second bottom connection portion 220, the residual material is still received in the second bottom groove 22 without projecting out of the second bottom wall 204 of the second pin element 2.

Figure 10:
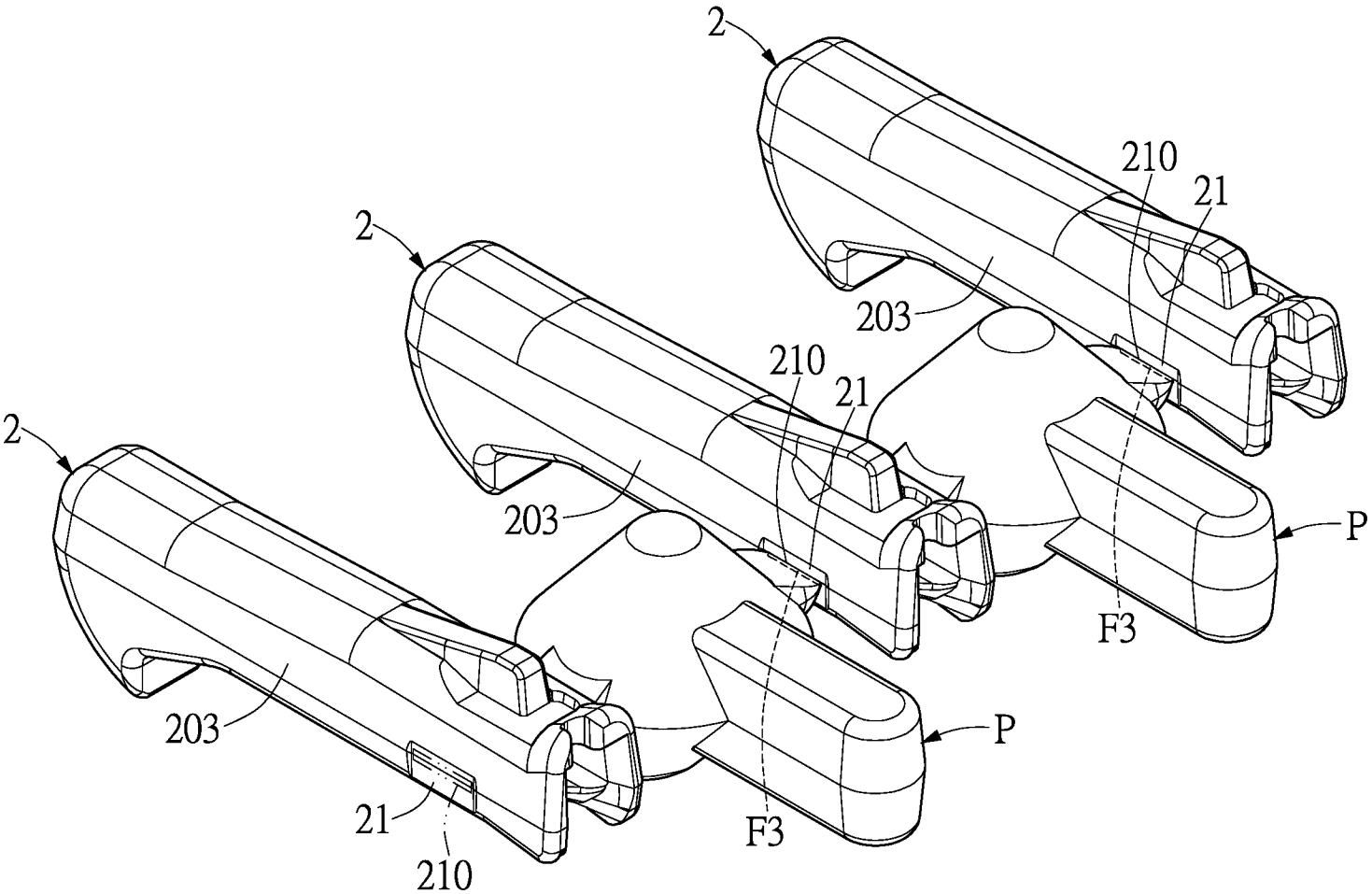
FIG. 10 shows a perspective schematic view of the second pin element being broken off so as to segregate the overflow particle according to the present disclosure.
Figure 11:
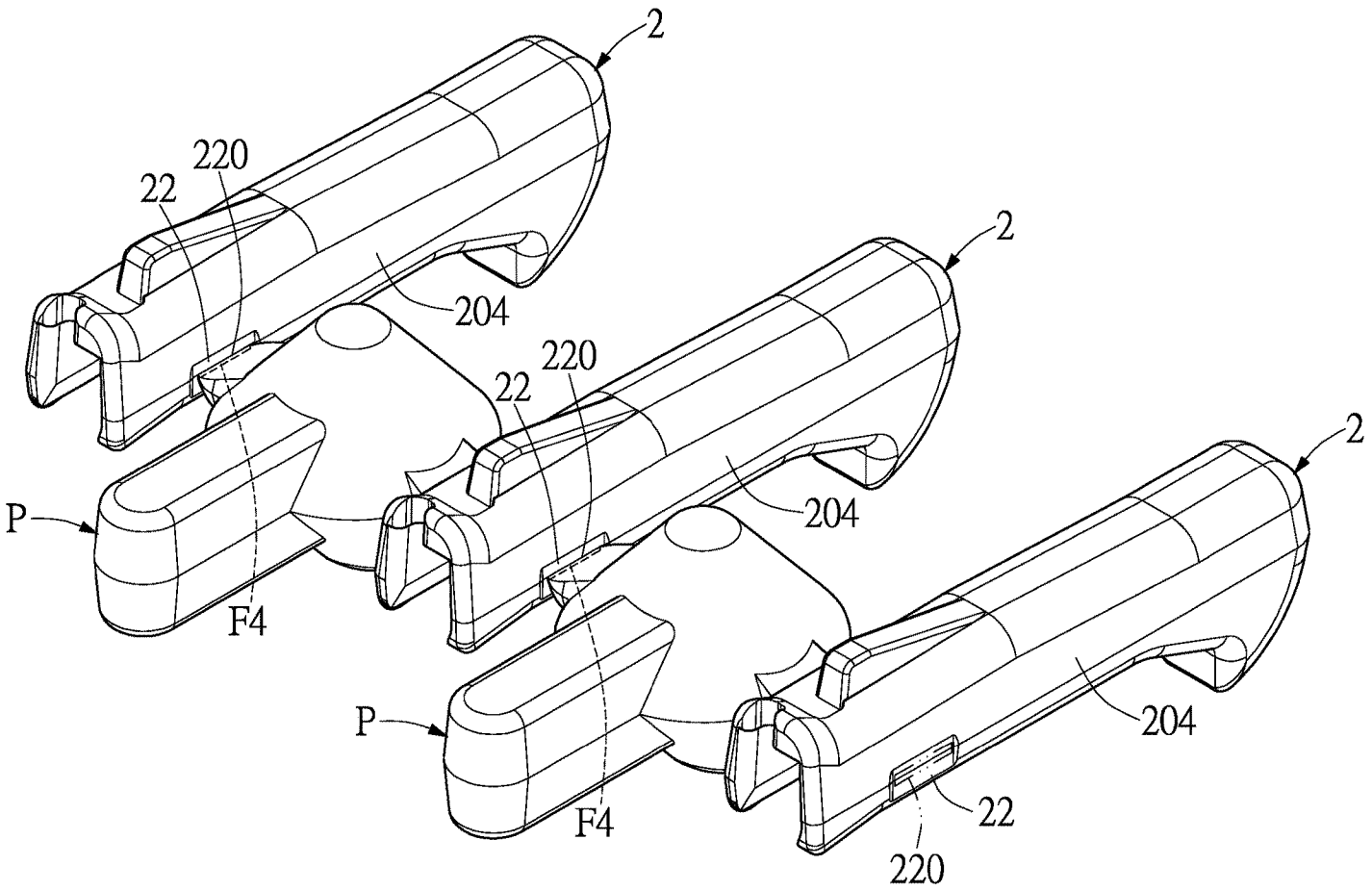
FIG. 11 shows another perspective schematic view of the second pin element being broken off so as to segregate the overflow particle according to the present disclosure.

In conclusion, the residual material is still received in the second top groove 21 without projecting out of the second top wall 203 of the second pin element 2 (that is to say, the residual material does not project out of the contours of the second pin element 2 as shown in FIG. 10), and the residual material is still received in the second bottom groove 22 without projecting out of the second bottom wall 204 of the second pin element 2 (that is to say, the residual material does not project out of the contours of the second pin element 2 as shown in FIG. 11), so that the efficiency of the automatic production line for making the second pin element 2 can be increased.

Referring to FIG. 12 to FIG. 16, the present disclosure further provides a zipper head assembly structure Z, including a zipper head assembly S2 and a pin-shaped assembly S1, and the pin-shaped assembly S1 is mated with the zipper head assembly S2.

Figure 12:
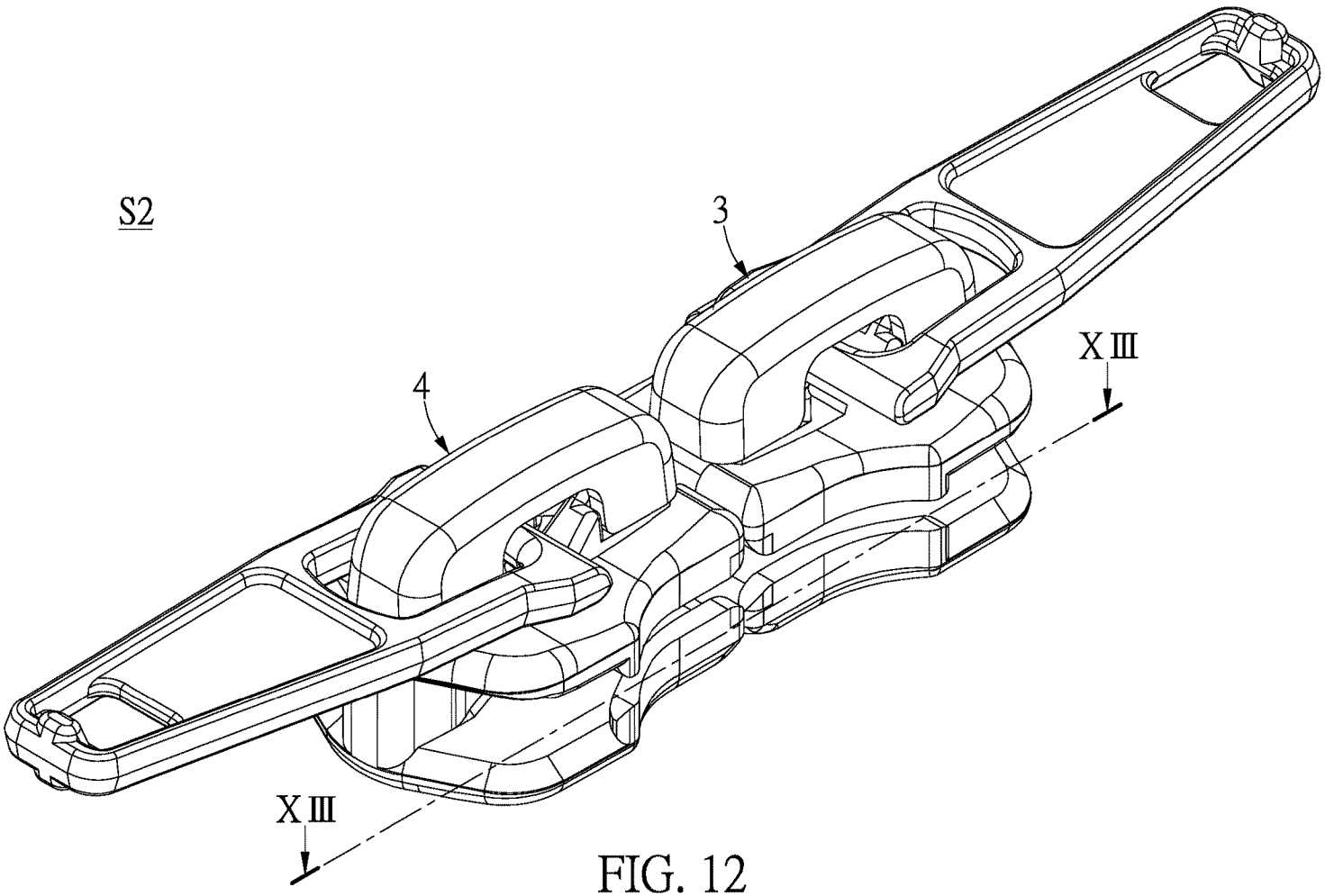
FIG. 12 shows a perspective schematic view of a first zipper head and a second zipper head being detachably mated with each other according to the present disclosure.
Figure 13:
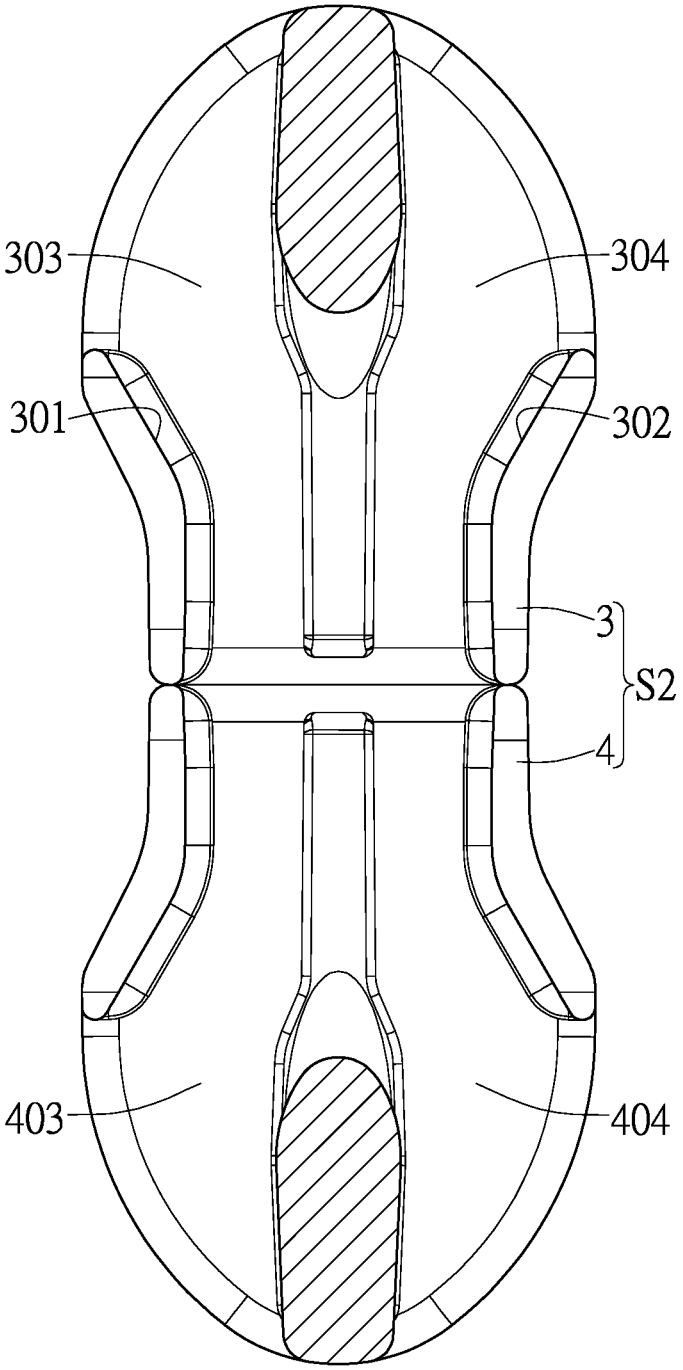
FIG. 13 shows a cross-sectional view taken along the sectional line XIII-XIII of FIG. 12.

First, referring to FIG. 12 and FIG. 13, the zipper head assembly S2 includes a first zipper head 3 and a second zipper head 4 detachably mated with the first zipper head 3, and the first zipper head 3 has a first inner wall 301 and a second inner wall 302 opposite to the first inner wall 301. More particularly, the first zipper head 3 has a first left chamber 303 and a first right chamber 304, and the second zipper head 4 has a second left chamber 403 and a second right chamber 404.

Figure 14:
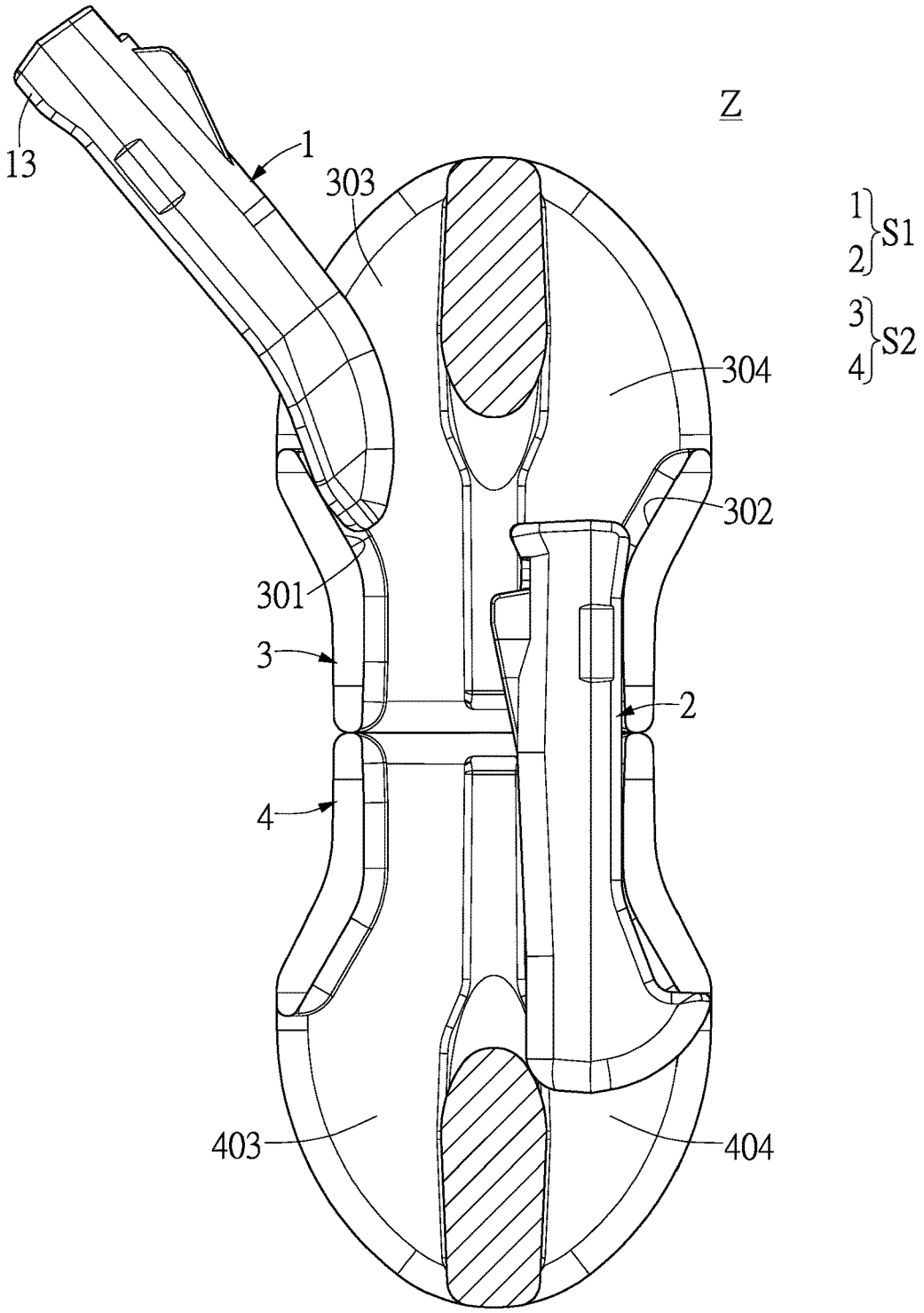
FIG. 14 shows a top schematic view of the first pin element being ready for insertion into a zipper head assembly structure according to the present disclosure.
Figure 15:
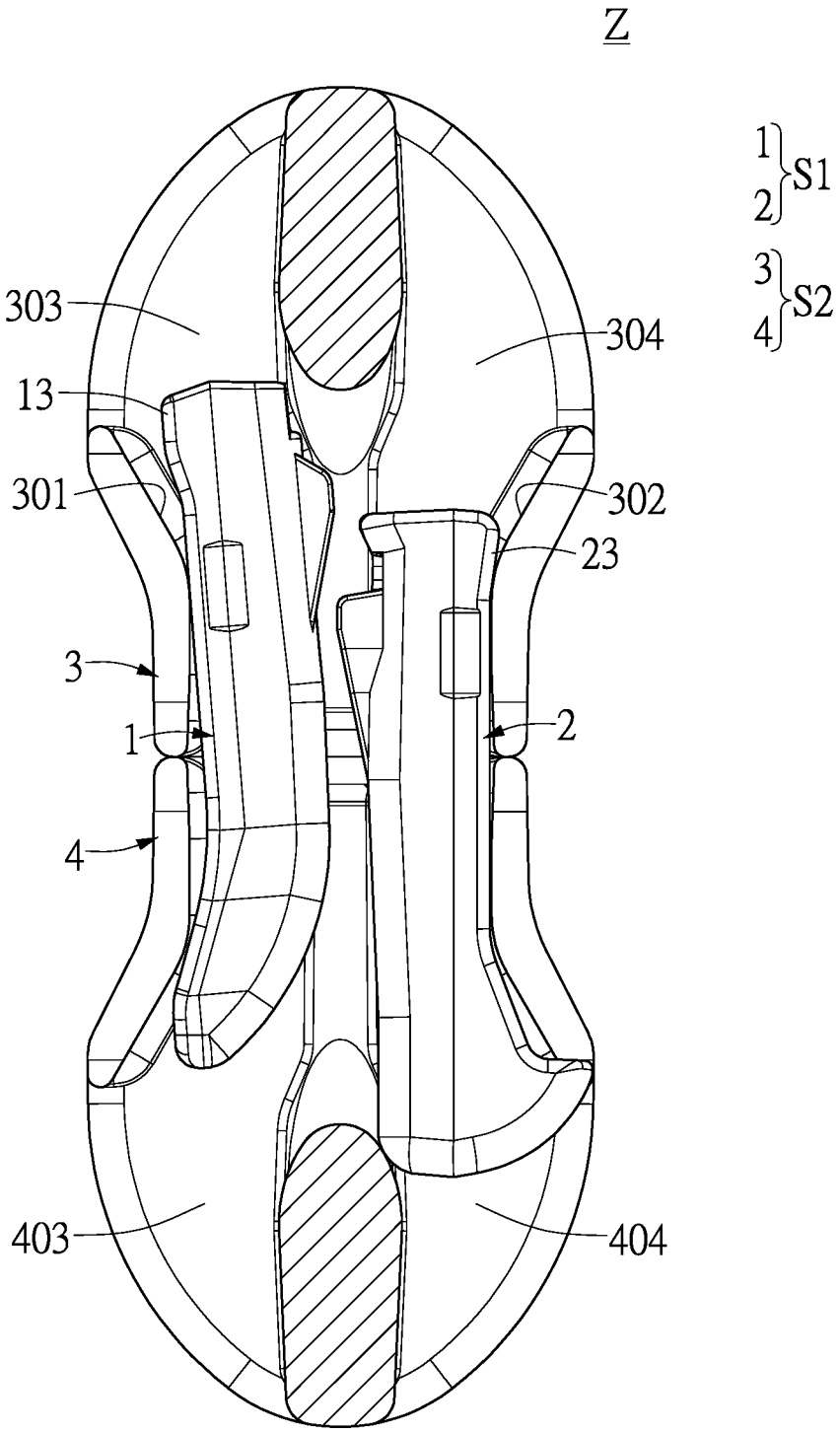
FIG. 15 shows a top schematic view of the first pin element being gradually inserted into the zipper head assembly structure according to the present disclosure.
Figure 16:
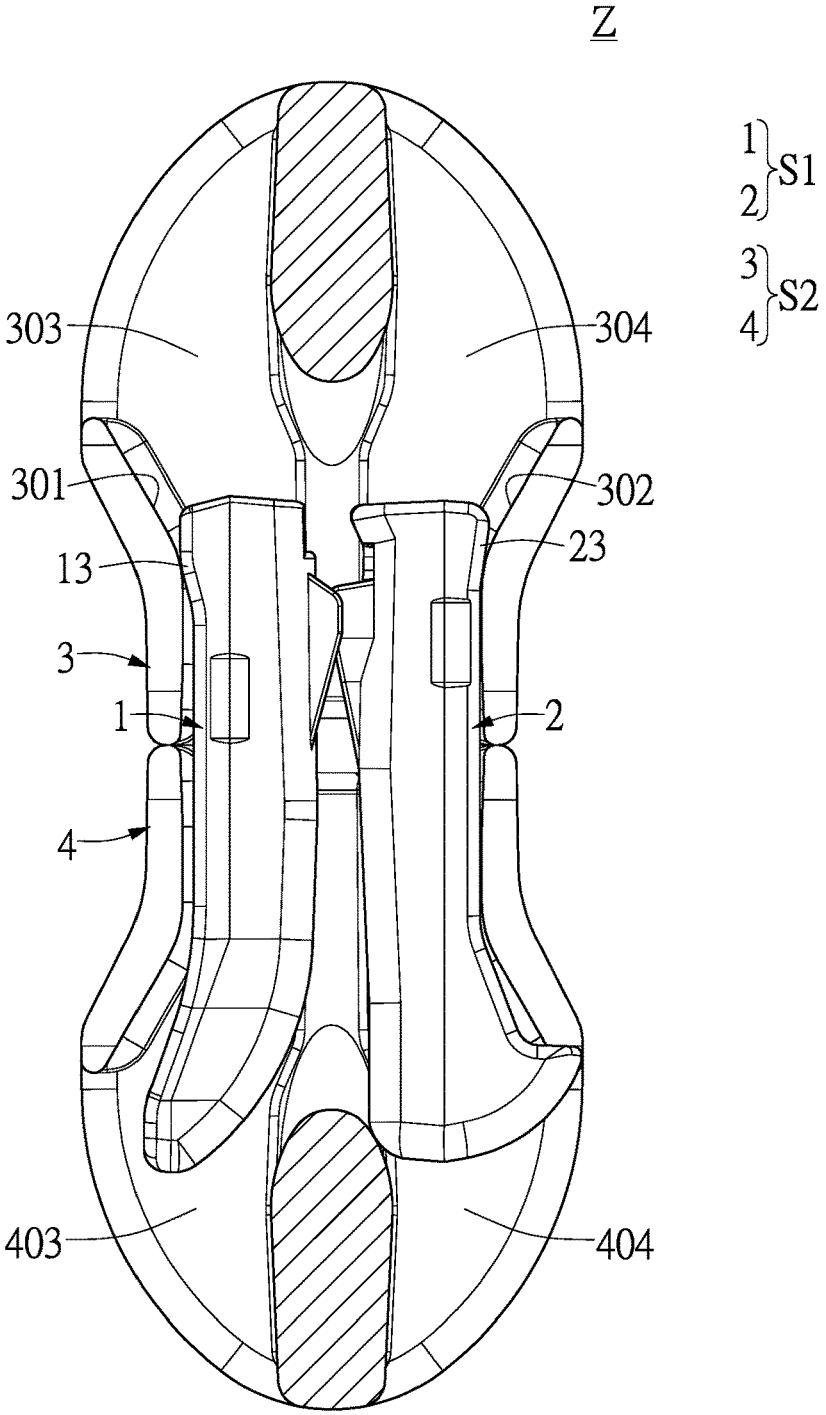
FIG. 16 shows a top schematic view of the first pin element having been totally inserted into the zipper head assembly structure according to the present disclosure.

Moreover, referring to FIG. 14 to FIG. 16, the pin-shaped assembly S1 includes a first pin element 1 and a second pin element 2, and both the first pin element 1 and the second pin element 2 are inserted into the zipper head assembly S2. More particularly, the first pin element 1 can be inserted into the first zipper head 3 and the second zipper head 4 and can be received inside the first left chamber 303 and the second left chamber 403, and the second pin element 2 can be inserted into the first zipper head 3 and the second zipper head 4 and can be received inside the first right chamber 304 and the second right chamber 404.

As described above, referring to FIG. 14 to FIG. 16, when the first pin element 1 is inserted into the first zipper head 3 and the second zipper head 4, the first flange portion 13 of the first pin element 1 is abutted by a first inner wall 301 of the first zipper head 3 so as to move the first pin element 1 toward the second pin element 2, and then the second flange portion 23 of the second element 2 is abutted by a second inner wall 302 of the second zipper head 4 so as to move the second pin element 2 toward the first pin element 1. Therefore, the first pin element 1 and the second pin element 2 can be detachably connected to each other by matching the first mating portion 14 and the second mating portion 24.

That is to say, referring to FIG. 14 to FIG. 16, when the first pin element 1 is inserted into the first zipper head 3 and the second zipper head 4, the first flange portion 13 of the first pin element 1 can be used to abut against the first inner wall 301 of the first zipper head 3 so as to quickly move the first pin element 1 toward the second pin element 2, and then the second flange portion 23 of the second element 2 can be used to abut against the second inner wall 302 of the second zipper head 4 so as to quickly move the second pin element 2 toward the first pin element 1, thus allowing the first mating portion 14 and the second mating portion 24 (or the first pin element 1 and the second pin element 2) to be mated quickly and stably.

It should be noted that even if the first pin element 1 is inserted into the zipper head assembly S2 with large chamber, the first flange portion 13 of the first pin element 1 can also be used to abut against the first inner wall 301 of the first zipper head 3 so as to quickly move the first pin element 1 toward the second pin element 2, thus allowing the first mating portion 14 and the second mating portion 24 (or the first pin element 1 and the second pin element 2) to be mated quickly and stably. Hence, the product suitability of the zipper head assembly structure Z and the pin-shaped assembly S1 thereof can be increased.

Therefore, by matching the features of "the first mating portion 14 being disposed on the first right wall 102 of the first body 10, and the second mating portion 24 being disposed on the second left wall 202 of the second body 20" and "the first mating portion 14 and the second mating portion 24 being mated with each other", the first pin element 1 and the second pin element 2 can be detachably connected to each other.

More particularly, the residual material can still be received in the first top groove 11 without projecting out of the first top wall 103 of the first pin element 1, and the residual material can still be received in the first bottom groove 12 without projecting out of the first bottom wall 104 of the first pin element 1, so that the efficiency of the automatic production line for making the first pin element 1 can be increased.

More particularly, the residual material can still be received in the second top groove 21 without projecting out of the second top wall 203 of the second pin element 2, and the residual material can still be received in the second bottom groove 22 without projecting out of the second bottom wall 204 of the second pin element 2, so that the efficiency of the automatic production line for making the second pin element 2 can be increased.

More particularly, when the first pin element 1 is inserted into the first zipper head 3 and the second zipper head 4, the first flange portion 13 of the first pin element 1 can be used to abut against the first inner wall 301 of the first zipper head 3 so as to quickly move the first pin element 1 toward the second pin element 2, and then the second flange portion 23 of the second element 2 can be used to abut against the second inner wall 302 of the second zipper head 4 so as to quickly move the second pin element 2 toward the first pin element 1, thus allowing the first mating portion 14 and the second mating portion 24 (or the first pin element 1 and the second pin element 2) to be mated quickly and stably.

The aforementioned descriptions merely represent the preferred embodiments of the present disclosure, without any intention to limit the scope of the present disclosure which is fully described only within the following claims. Various equivalent changes, alterations or modifications based on the claims of the present disclosure are all, consequently, viewed as being embraced by the scope of the present disclosure.

What is claimed is:

1. A pin-shaped assembly, comprising:

a first pin element including a first body, a first flange portion, a first mating portion, and a first front portion, wherein the first body has a first left wall and a first right wall opposite to the first left wall; and a second pin element including a second body, a second flange portion, a second mating portion, and a second front portion, wherein the second body has a second left wall and a second right wall opposite to the second left wall;

wherein the first flange portion is projected outwardly from the first left wall of the first body and is adjacent to a rear side of the first body, the first mating portion is disposed on the first right wall of the first body, and the first front portion is disposed on a front side of the first body;

wherein the second flange portion is projected outwardly from the second right wall of the second body and is adjacent to a rear side of the second body, the second mating portion is disposed on the second left wall of the second body, and the second front portion is disposed on a front side of the second body;

wherein the first pin element and the second pin element are detachably connected to each other by matching the first mating portion and the second mating portion;

wherein the first body has a first top wall connected between the first left wall and the first right wall, and a first bottom wall opposite to the first top wall, and the first pin element has a first top groove and a first bottom groove, wherein the first top groove is disposed on the first top wall of the first body, and the first bottom groove is disposed on the first bottom wall of the first body, wherein the first top groove has a first top connection portion being communicated with a first overflow opening, and the first bottom groove has a first bottom connection portion being communicated with a second overflow opening.

2. The pin-shaped assembly of claim 1, wherein the second body has a second top wall connected between the second left wall and the second right wall, and a second bottom wall opposite to the second top wall, and the second pin element has a second top groove and a second bottom groove, wherein the second top groove is disposed on the second top wall of the second body, and the second bottom groove is disposed on the second bottom wall of the second body, wherein the second top groove has a second top connection portion being communicated with a third overflow opening, and the second bottom groove has a second bottom connection portion being communicated with a fourth overflow opening.

3. The pin-shaped assembly of claim 1, wherein the first flange portion of the first pin element is abutted by a first inner wall of a first zipper head so as to move the first pin element toward the second pin element, and the second flange portion of the second element is abutted by a second inner wall of a second zipper head so as to move the second pin element toward the first pin element, wherein the first pin element is an inserting pin, and the second pin element is a fixed pin.

4. A pin-shaped assembly, comprising:

a first pin element including a first body, a first top groove, a first bottom groove, a first mating portion, and a first front portion, wherein the first body has a first left wall, a first right wall opposite to the first left wall, a first top wall connected between the first left wall and the first right wall, and a first bottom wall opposite to the first top wall; and a second pin element including a second body, a second top groove, a second bottom groove, a second mating portion, and a second front portion, wherein the second body has a second left wall, a second right wall opposite to the second left wall, a second top wall connected between the second left wall and the second right wall, and a second bottom wall opposite to the second top wall;

wherein the first top groove is disposed on the first top wall of the first body, the first bottom groove is disposed on the first bottom wall of the first body, the first mating portion is disposed on the first right wall of the first body, and the first front portion is disposed on a front side of the first body;

wherein the second top groove is disposed on the second top wall of the second body, the second bottom groove is disposed on the second bottom wall of the second body, the second mating portion is disposed on the second left wall of the second body, and the second front portion is disposed on a front side of the second body;

wherein the first pin element and the second pin element are detachably connected to each other by matching the first mating portion and the second mating portion.

5. The pin-shaped assembly of claim 4, wherein the first top groove has a first top connection portion being communicated with a first overflow opening, and the first bottom groove has a first bottom connection portion being communicated with a second overflow opening, wherein the second top groove has a second top connection portion being communicated with a third overflow opening, and the second bottom groove has a second bottom connection portion being communicated with a fourth overflow opening.

6. The pin-shaped assembly of claim 4, wherein the first pin element includes a first flange portion, and the first flange portion is projected outwardly from the first left wall of the first body and is adjacent to a rear side of the first body, wherein the second pin element including a second flange portion, and the second flange portion is projected outwardly from the second right wall of the second body and is adjacent to a rear side of the second body, wherein the first flange portion of the first pin element is abutted by a first inner wall of a first zipper head so as to move the first pin element toward the second pin element, and the second flange portion of the second element is abutted by a second inner wall of a second zipper head so as to move the second pin element toward the first pin element, wherein the first pin element is an inserting pin, and the second pin element is a fixed pin.

7. A zipper head assembly structure, comprising:

a zipper head assembly including a first zipper head and a second zipper head detachably mated with the first zipper head, wherein the first zipper head has a first inner wall and a second inner wall opposite to the first inner wall; and a pin-shaped assembly mated with the zipper head assembly, wherein the pin-shaped assembly includes a first pin element and a second pin element, and both the first pin element and the second pin element are inserted into the zipper head assembly;

wherein the first pin element includes a first body, a first flange portion, a first mating portion, and a first front portion, and the first body has a first left wall and a first right wall opposite to the first left wall, wherein the first flange portion is projected outwardly from the first left wall of the first body and is adjacent to a rear side of the first body, the first mating portion is disposed on the first right wall of the first body, and the first front portion is disposed on a front side of the first body;

wherein the second pin element includes a second body, a second flange portion, a second mating portion, and a second front portion, and the second body has a second left wall and a second right wall opposite to the second left wall, wherein the second flange portion is projected outwardly from the second right wall of the second body and is adjacent to a rear side of the second body, the second mating portion is disposed on the second left wall of the second body, and the second front portion is disposed on a front side of the second body;

wherein the first pin element and the second pin element are detachably connected to each other by matching the first mating portion and the second mating portion;

wherein the first body has a first top wall connected between the first left wall and the first right wall, and a first bottom wall opposite to the first top wall, and the first pin element has a first top groove and a first bottom groove, wherein the first top groove is disposed on the first top wall of the first body, and the first bottom groove is disposed on the first bottom wall of the first body, wherein the first top groove has a first top connection portion being communicated with a first overflow opening, and the first bottom groove has a first bottom connection portion being communicated with a second overflow opening.

8. The zipper head assembly structure of claim 7, wherein the second body has a second top wall connected between the second left wall and the second right wall, and a second bottom wall opposite to the second top wall, and the second pin element has a second top groove and a second bottom groove, wherein the second top groove is disposed on the second top wall of the second body, and the second bottom groove is disposed on the second bottom wall of the second body, wherein the second top groove has a second top connection portion being communicated with a third overflow opening, and the second bottom groove has a second bottom connection portion being communicated with a fourth overflow opening, wherein the first zipper head has a first left chamber and a first right chamber, and the second zipper head has a second left chamber and a second right chamber, wherein the first pin element is inserted into the first zipper head and the second zipper head and is received inside the first left chamber and the second left chamber, and the second pin element is inserted into the first zipper head and the second zipper head and is received inside the first right chamber and the second right chamber.

* * * * *